US007682181B1

(12) United States Patent
Jones, Jr. et al.

(10) Patent No.: US 7,682,181 B1
(45) Date of Patent: Mar. 23, 2010

(54) LATCH SECURING MEMBER

(75) Inventors: Royal Curtis Jones, Jr., Thomasville, NC (US); Roy Kenneth Whitaker, Jr., Kernersville, NC (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/207,073

(22) Filed: Sep. 9, 2008

(51) Int. Cl.
*H01R 13/62* (2006.01)

(52) U.S. Cl. ..... 439/352

(58) Field of Classification Search ..... 439/352, 439/358, 357, 489
See application file for complete search history.

(56) References Cited

U.S. PATENT DOCUMENTS 4,634,204 A * 1/1987 Detter et al. ..... 439/347
4,746,306 A 5/1988 Yurtin et al.
4,946,404 A * 8/1990 Takenouchi et al. ..... 439/352
4,950,179 A 8/1990 Takenouchi et al.
5,382,177 A 1/1995 Hutchinson, Jr. et al.
5,507,666 A 4/1996 Yamanashi
5,681,178 A * 10/1997 Kunkle et al. ..... 439/352
5,720,629 A 2/1998 Self, Jr. et al.
5,848,912 A * 12/1998 Okabe ..... 439/489
6,024,594 A 2/2000 Self, Jr. et al.
6,109,955 A * 8/2000 Hanazaki et al. ..... 439/489
6,450,830 B1 * 9/2002 Koseki ..... 439/352
6,506,070 B1 1/2003 Huang
6,692,289 B2 2/2004 Nemoto
7,033,201 B2 4/2006 Ichida et al.
7,156,684 B2 1/2007 Ichida et al.
7,160,134 B2 1/2007 Ichida et al.
7,326,074 B1 * 2/2008 Lim et al. ..... 439/352
7,399,195 B2 * 7/2008 Kim et al. ..... 439/352
7,476,123 B2 * 1/2009 Kobayashi et al. ..... 439/489
7,484,991 B1 * 2/2009 Kelaher et al. ..... 439/372
2004/0023547 A1 * 2/2004 Oka ..... 439/352
2005/0245123 A1 * 11/2005 Shimizu ..... 439/352

* cited by examiner

*Primary Examiner*—Gary F. Paumen

(57) ABSTRACT

A latch securing member for use in maintaining a first connector having at least one latching arm in latching engagement with a second connector having at least one latch projection. The latch securing member has an inclined member which extends from proximate a front face to a rear wall, with the inclined member being positioned proximate a bottom wall at the front face and inclined toward a top surface. At least one securing arm extends from the rear wall toward the front face and is positioned proximate the top surface. The inclined member is positioned to cooperate with the latching arm of the first connector to prevent the latching arm from disengagement from the latching projection of the second connector. The securing arm cooperates with the latching arm to maintain the latch securing member in position relative to the latching arm.

18 Claims, 6 Drawing Sheets

LATCH SECURING MEMBER

FIELD OF THE INVENTION

The present invention relates to an electrical connector having matable connector halves that are latched together. More particularly, the invention relates to a latch securing member that cooperates with the latch of at least one connector half to prevent the unwanted disengagement of the connector halves.

BACKGROUND OF THE INVENTION

Electrical connectors having connector position assurance members (CPA) or other means to prevent disengagement of locking latches are known in the industry. One such electrical connector is disclosed in U.S. Pat. No. 4,746,306. This connector has dielectric connector bodies that are coupled and locked together by a resilient lock member of one connector body which snaps past and engages a lock member of the other connector body. The resilient lock member includes a slot that extends through one end and a lock shoulder that faces the opposite end thereof. The other lock member includes a lock shoulder and a loop that passes through the slot of the resilient lock member and cooperatively forms a gauge hole of a predetermined size with the resilient lock member when the connector bodies are coupled and locked together by the lock shoulders. A gauge pin having a shank of substantially the same predetermined size is disposed in the gauge hole to indicate that the connector bodies are locked together by the lock shoulders. This known connector assembly provides a means of indicating that the connector bodies are locked together and a means to prevent the accidental unlocking of the connector bodies. However, the gauge pin member is inserted in a direction transverse to the insertion direction of the matable connector bodies, which insertion may be difficult in close working areas.

Another known connector is disclosed in U.S. Pat. No. 5,507,666. This connector has a lock securing member for securing mutual fitting of connectors for use in, e.g., connecting electric wires to each other, which can sense a half-fitted condition between connector housings. A lock arm is provided in a male housing, and a lock securing member having flexible latch fingers is attached to the male housing in a temporarily engaged condition where the flexible latch fingers are positioned to extend along the lock arm and also abut with the lock arm. A female housing has engagement releasing drive sticks which function to move the flexible latch fingers upward to release the temporary engagement between the male housing and the lock securing member so that the lock securing member can be moved into a completely engaged condition, when both the housings are fitted to each other. A raised sensing piece having an inclined surface is provided at a free end of the lock arm, and a sensing projection coming into abutment with the raised sensing piece is provided on the lock securing member. However, in this connector, once the securing member is moved into the fully secured position, it is difficult to remove the securing member, thereby making it difficult to unmate the connector housings.

It would therefore be beneficial to have a latch securing member that could be inserted along the insertion direction of the matable connectors, thereby minimizing the space required for operation. It would also be beneficial to have a securing member that could be removed by the operator, if the matable connectors are to be intentionally unmated. Additionally, having a locking member which could be brought into engagement with the connector without the need for special passages or projections being provided on the connector would allow the use of the locking member on existing connectors. This allows existing connectors to be retrofitted with a locking member, thereby eliminating the need to replace existing connectors.

SUMMARY OF THE INVENTION

The invention is directed to a latch securing member for use in maintaining a first connector having at least one latching arm in latching engagement with a second connector having at least one latch projection. The latch securing member has a front face, a rear wall and sidewalls extending therebetween. A bottom wall extends from the rear wall in a direction essentially perpendicular to the rear wall. An inclined member extends from proximate the front face to the rear wall, with the inclined member being positioned proximate the bottom wall at the front face and inclined toward a top surface. At least one securing arm extends from the rear wall toward the front face and is positioned proximate the top surface. The inclined member is positioned to cooperate with the latching arm of the first connector to prevent the latching arm from disengagement from the latching projection of the second connector. The securing arm cooperates with the latching arm to maintain the latch securing member in position relative to the latching arm.

Each securing arm has an inclined surface provided on a portion of the securing arm that is positioned nearest the front face. A securing shoulder is provided proximate the inclined surface. An alignment member projects from the front face and is positioned in essentially the same place as the bottom wall. Lead-in surfaces are positioned on either side of the alignment member.

The invention is also directed to a connector assembly having a first connector housing, a second connector housing and a latch securing member. The first connector housing has a latch member that extends from a first wall of the first connector housing, with the latch member having a latch projection engagement section and a disengagement section. The second connector housing has a latch projection that extends from a second wall of the second connector housing and cooperates with the latch projection engagement section of the first connector when the first and second connector are mated together. The latch securing member has an inclined member and a securing arm. The inclined member cooperates to maintain the disengagement section of the first connector in position when the latch securing projection is properly mated to the first connector housing and the securing arm cooperates with the disengagement section to prevent the removal of the latch securing member from the latch member.

When the connector assembly is fully mated, the latch projection engagement section of the first connector housing engages the latch projection of the second connector housing to form a locking member. Additionally, the disengagement section of the first connector housing engages the inclined member of the latch securing member which prevents the disengagement section from being moved to a disengagement position. This ensures that the latch projection engagement section will remain in contact with the latch projection, preventing the disengagement of the first connector housing from the second connector housing.

The latch securing member of the present invention has numerous advantages. As the latch securing member is inserted in a direction which is essentially parallel to the longitudinal axis of the connector, the latch securing member can be used in environments in which space between components must be minimized. The latch securing member can also be used on connectors already installed in the field. As the latch securing members cooperates with known latch members, the housing of the connectors do not have to be modified to accommodate the latch securing members. Many latch securing members currently available require the connector housing to have specific openings or shoulders provided therein to accommodate the latch securing members. No such special molding of the connector housings is required for this invention. The invention also required no special tools for insertion or removal. This facilitates the effective usefulness of the present invention in the marketplace.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
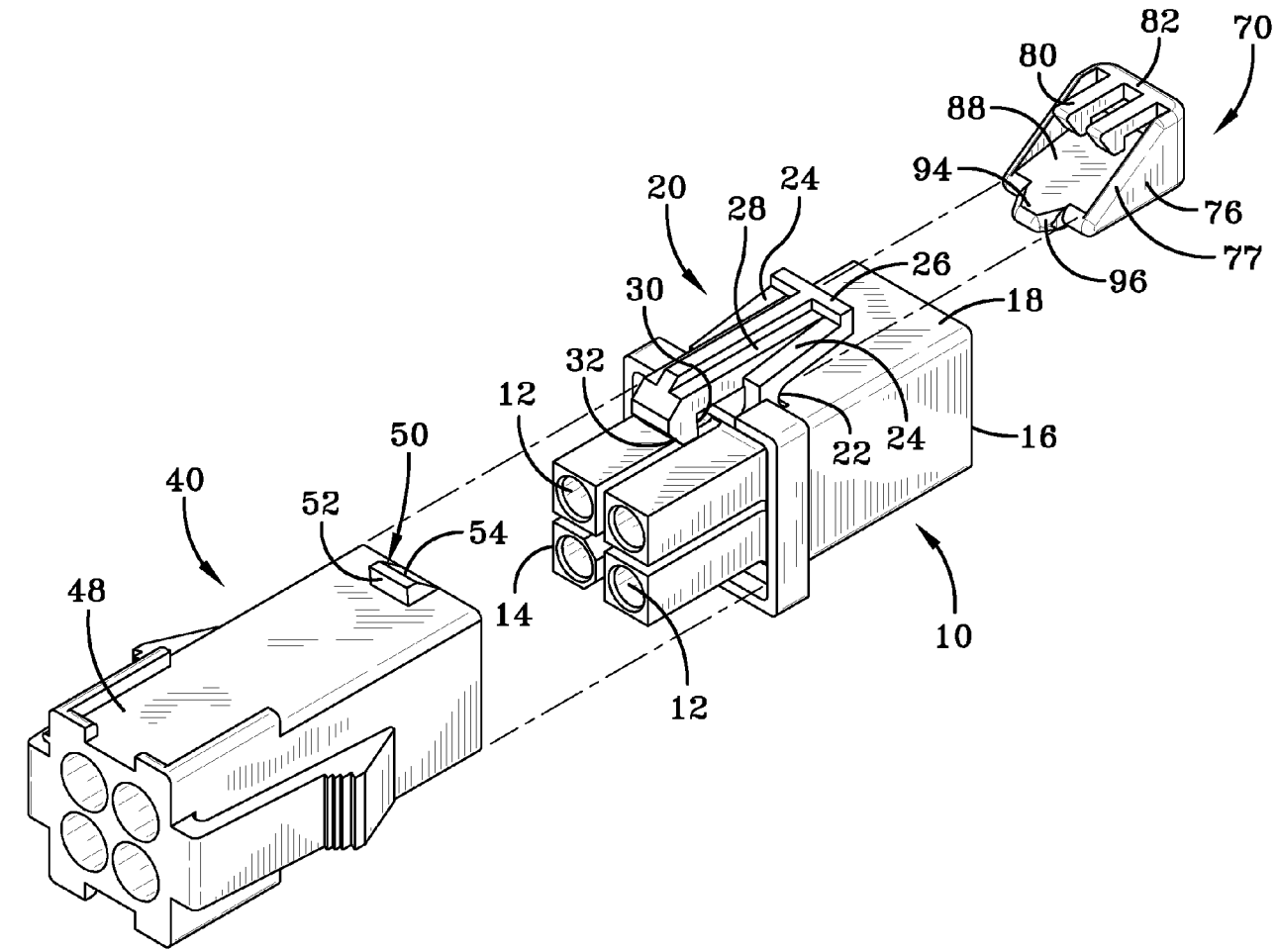
FIG. 1 is an exploded perspective view showing a female housing, a male housing and a latch securing member of the present invention.

With reference to FIGS. 1, 2, 3, 7, 8 and 9 a connector assembly has a male connector housing 10, a female connector housing 40 and a latch securing member 70. The male connector housing 10 is a dielectric body which has a plurality of terminal receiving cavities 12 extending therethrough from a front face 14 to a rear face 16. Each of the cavities 12 is shown to have a cylindrical cross-section as it enters the rear face, although other cross-sectional shapes are encompassed within the scope of the invention. Pin type terminals (not shown) are insertable into the cavities 12. Extending from a side wall 18 is a latch member 20. In the configuration shown, the latch member 20 has two pivot members 22 which are attached to the sidewall 18. Two extension arms 24 extend from the pivot members 22 to a disengagement section 26. A latch arm 28 extends from the disengagement section 26 beyond pivot members 22 toward the front face 14 of the housing 10. A latching shoulder 30 and an inclined surface 32 are provided on a free end portion of the latch arm 28 that extends nearest the front face 14 of the housing 10.

The female connector housing 40 is a dielectric body which has a plurality of terminal receiving cavities 42 extending therethrough from a front face 44 to a rear face 46. Each of the cavities 42 is shown to have a cylindrical cross-section as it enters the rear face, although other cross-sectional shapes are encompassed within the scope of the invention. Socket type terminals (not shown) are insertable into the cavities 42. Extending from a portion of a side wall 48 nearest the front face 44 of the housing 40 is a latch projection 50. The latch projection 50 has a latching shoulder 52 and an inclined surface 54.

As the invention is directed to a latch securing member 70 which can be used with various connector housings, including connectors with one or more latch arms and latch projections, which are well known in the industry, a more detailed description of the housing 10 and housing 40 will not be provided.

Figure 5:
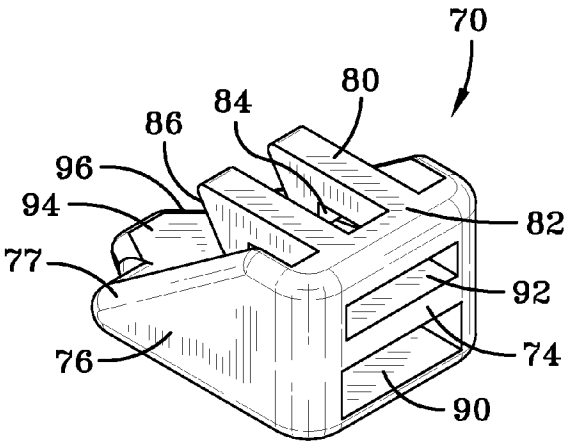
FIG. 5 is a back perspective view of the latch securing member.
Figure 4:
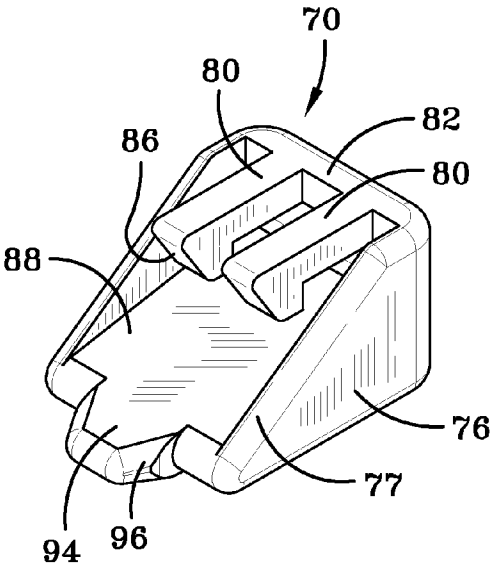
FIG. 4 is a front perspective view of the latch securing member.
Figure 6:
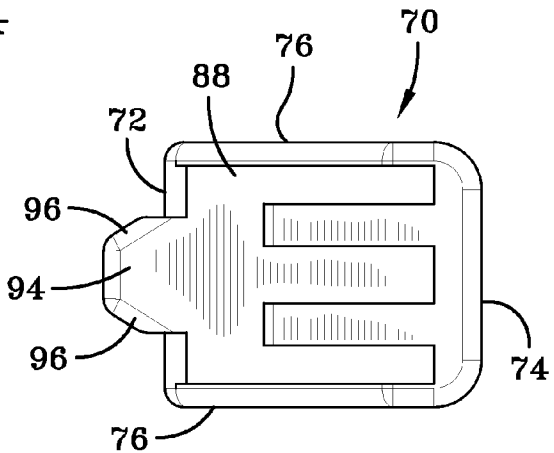
FIG. 6 is a top view of the latch securing member.

Referring to FIGS. 4 through 6, the latch securing member 70 has a front face 72, a rear wall 74 and sidewalls 76 extending therebetween. Each sidewall 76 has a side surface 77 that extends from proximate the front face 72 toward the rear wall 74. Each side surface 77 is positioned proximate the bottom wall 78 (shown in FIG. 7) at the front face and is inclined toward the top surface 82 as it approaches the rear wall 74. Bottom wall 78 is also provided and extends in a direction that is essentially perpendicular to the rear wall 74. Securing arms 80 extend from the rear wall 74 and are integral with a top surface 82 of latch securing member. The securing arms have securing shoulders 84 and inclined surfaces 86 provided on the portions of the securing arms nearest the front face 72. An inclined member 88 extends from proximate the front face 72 to the rear wall 74. The inclined member 88 is positioned proximate the bottom wall 78 at the front face and is inclined toward the top surface 82 as it reaches the rear wall 74. As best shown in FIGS. 5 and 7 through 9, a first opening 90 extends through rear wall 74 and is positioned below inclined member 88. A second opening 92 also extends through rear wall 74 and is positioned above the inclined member 88. An alignment member 94 projects from front face 72, the alignment member 94 is positioned in essentially the same plane as the bottom wall 78. Lead-in surfaces 96 are positioned on either side of the alignment member 94.

Figure 7:
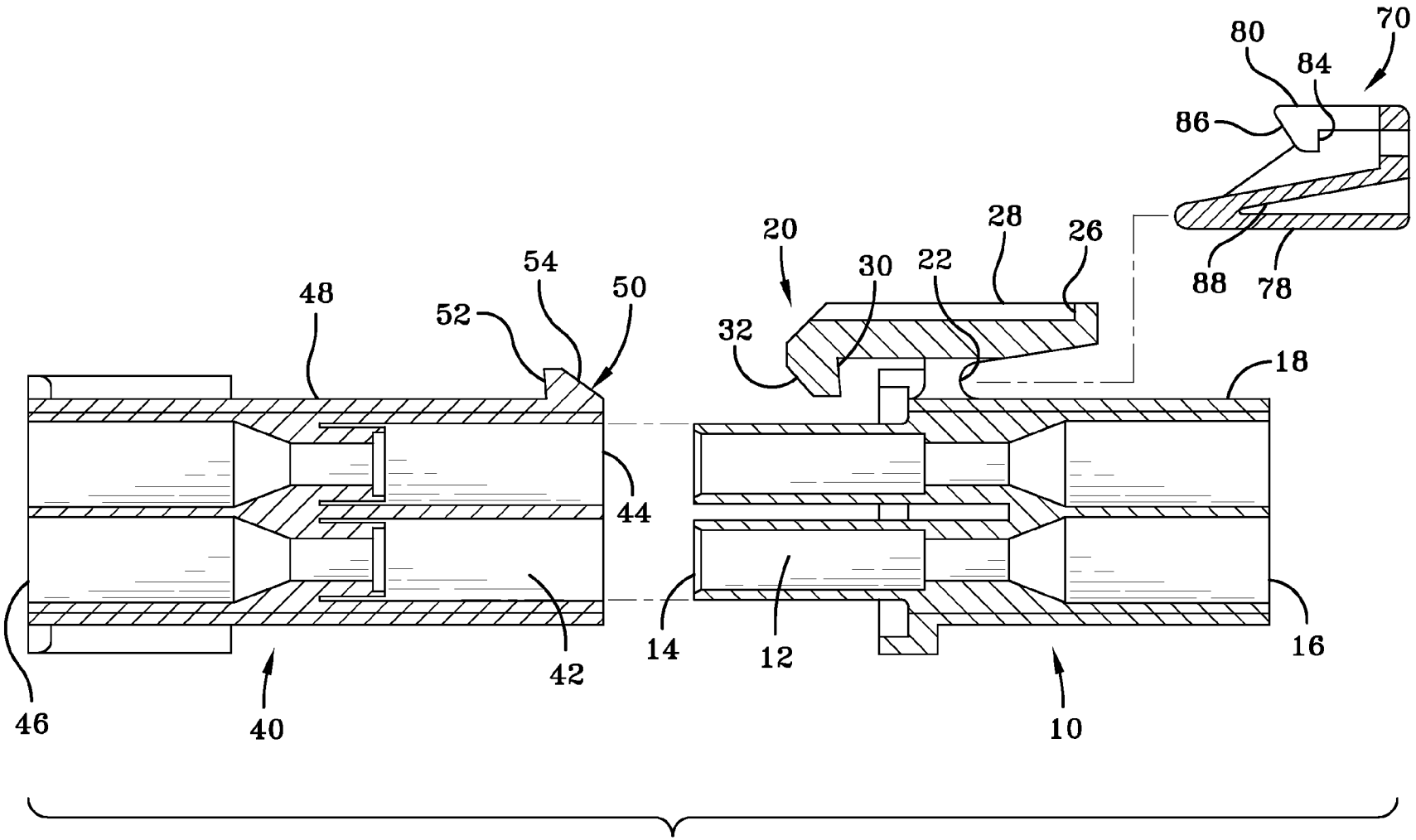
FIG. 7 is a partial cross-sectional view, taken along line 7-7 of FIG. 3, showing the female housing, male housing and latch securing member prior to mating.
Figure 8:
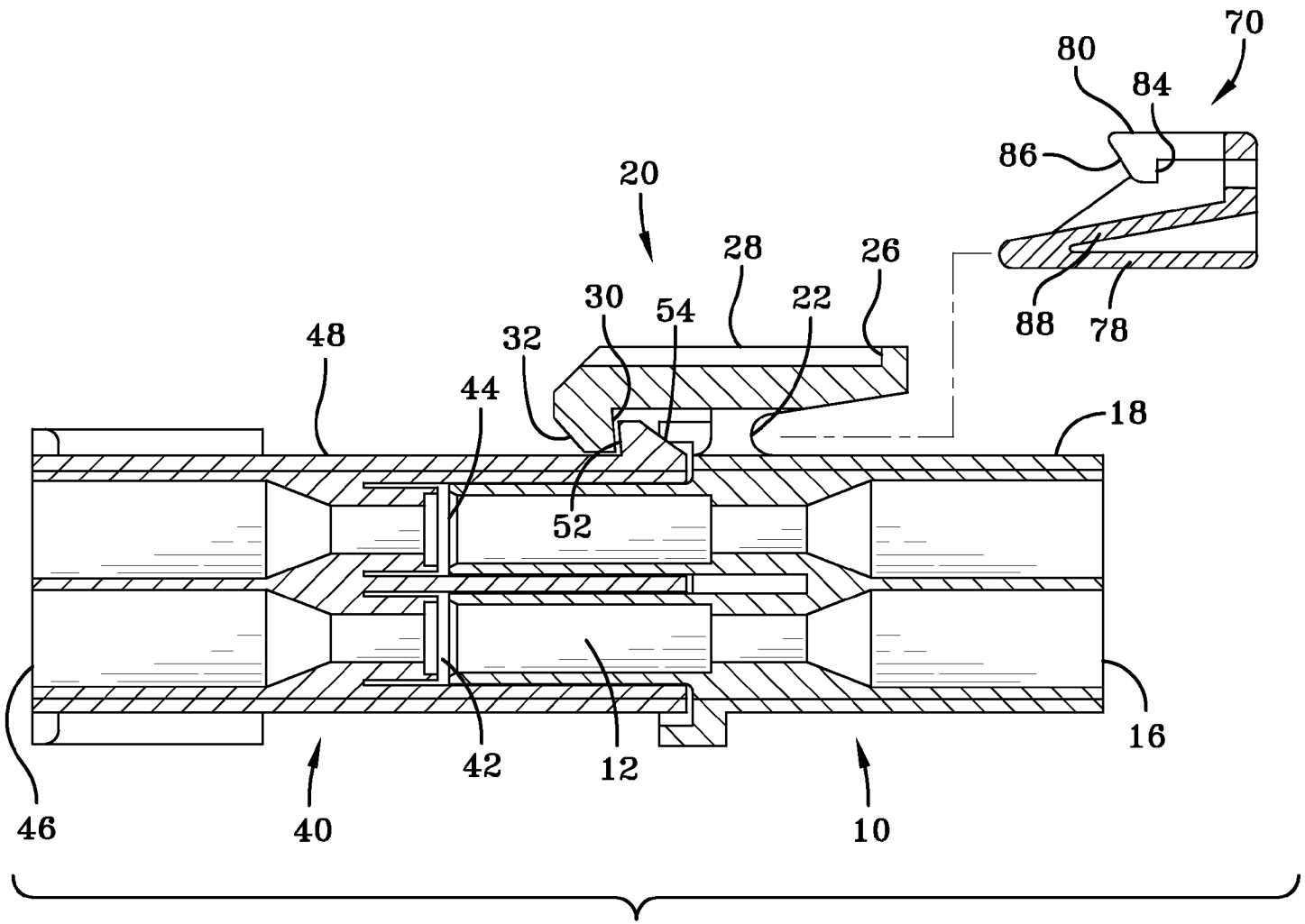
FIG. 8 is a partial cross-sectional view, similar to FIG. 7, showing the female housing mated with the male housing and prior to the insertion of the latch securing member.
Figure 9:
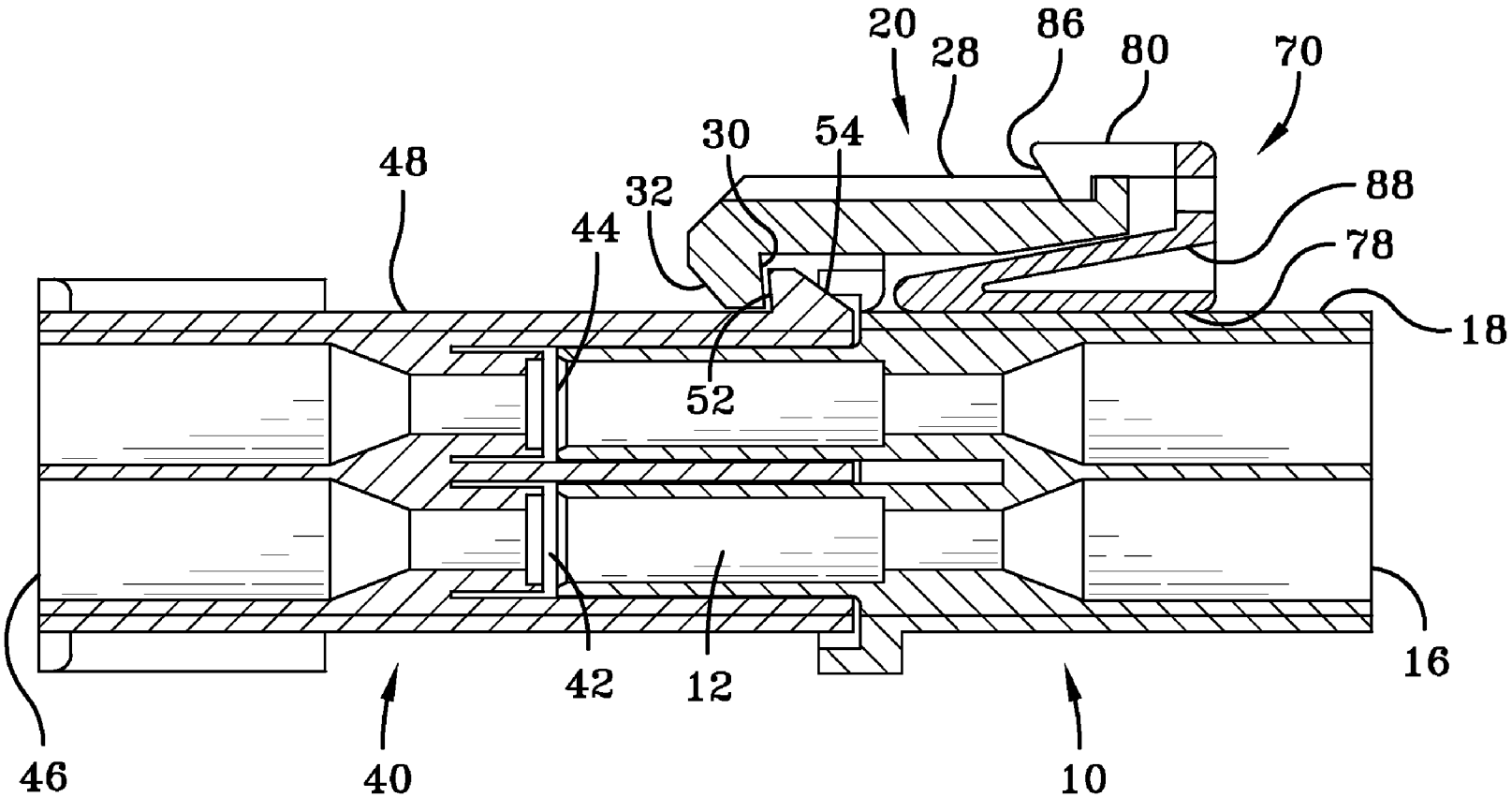
FIG. 9 is a partial cross-sectional view, similar to FIG. 7, showing the female housing mated with the male housing and the latch securing member inserted to cooperate with the male housing.

Referring to FIGS. 7 through 9, the movement of the male connector housing 10, the female connector housing 40 and the latch securing member from an unassembled position to a fully assembled position is represented. As housing 10 and housing 40 are moved from the position shown in FIG. 7 to the position shown in FIG. 8, the front face 14 of connector 10 enters connector 40 through the front face 44 thereof. As the insertion of the connectors continues, the inclined surface 32 of latch member 20 engages the inclined surface 54 of latch projection 50. The continued insertion causes the inclined surface 32 to be pushed upward (as viewed in the drawing) by inclined surface 54, thereby causing the extension arms 24, disengagement section 26, latch arm 28, latching shoulder 30 and inclined surface 32 to be resiliently rotated about pivot members 22. This pivoting motion continues until the inclined surface 32 moves beyond the inclined surface 54, thereby allowing the latch member 32 to resiliently rotate back to its unstressed position. In this unstressed position, as shown in FIG. 8, the latching shoulder 30 of latching arm 28 is placed proximate latching shoulder 52 of latch projection 50. In this position, and absent any outside objects or forces being exerted to the latch member 20, the latching shoulder 30 will cooperate with the latching shoulder 52 to prevent the unwanted separation of housing 10 and housing 40. However, when the connector housings 10 and 40 are mated as shown in FIG. 8, there is some likelihood that the latch member 20 will be accidentally disengaged from latch projection 50 due to wires being tangled around the latch arm, inadvertent touching when another component is installed or repaired, or any of a number of other reasons. This can result in the connector housing 10 and 40 moving away from each other causing the electrical connection between the contacts to be lost. This can occur whether the female connector housing 40 is configured for use as a cable connector (as shown) or as a printed circuit board connector (not shown).

In order to avoid the problem discussed above, the latch securing member 70 is moved from the position shown in FIG. 8 to the position shown in FIG. 9. As this movement occurs, the bottom wall 78 of the latch securing member 70 engages and generally rides along the sidewall 18 of male connector housing 10. Inside surfaces of sidewalls 74 move proximate the outside surfaces of the respective extension arms 24 of the latch member 20, thereby trapping the extension arms 24 between the sidewalls 74 to ensure that the latch member 20 will be maintained within the latch securing member 70. As the insertion continues, alignment member 94 is moved between the pivot members 22. The positioning of the alignment member 94 is facilitated by lead-in surfaces 96 positioned on either side of the alignment member 94. The lead-in surfaces rectify any slight misalignment of the latch securing member 70 relative to the latch member 20 as insertion occurs.

Also during the insertion of the latch securing member 70, the inclined surfaces 86 of the securing arms 80 engage the disengagement section 28 of the latch member 20 causing the securing arms 80 to be resiliently deformed in a direction away from the bottom wall 78. As insertion continues, the inclined surfaces 86 move beyond the disengagement section 28, thereby allowing the securing arms 80 to resiliently return to their unstressed position, as shown in FIG. 9.

Figure 2:
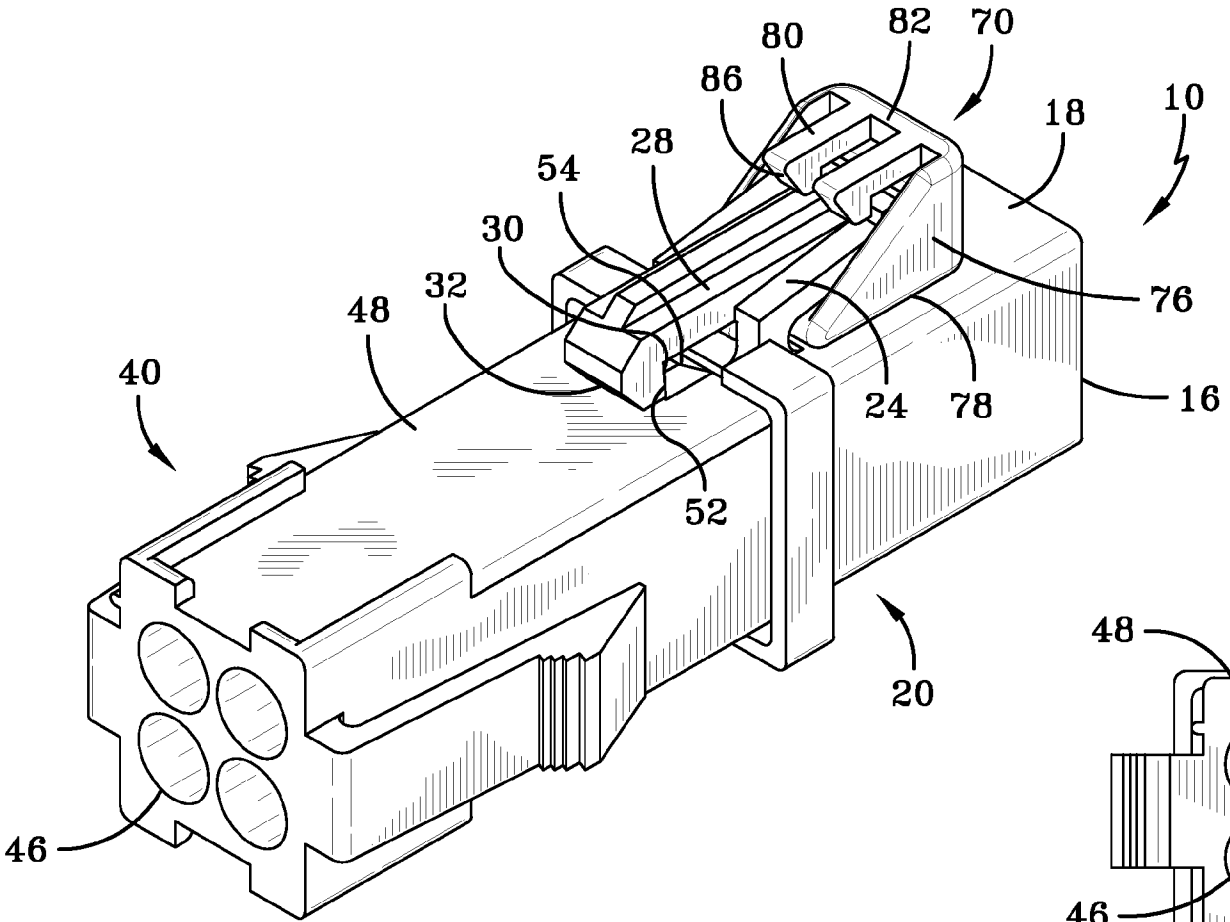
FIG. 2 is a perspective view of showing the female housing, male housing and the latching securing member fully assembled.
Figure 3:
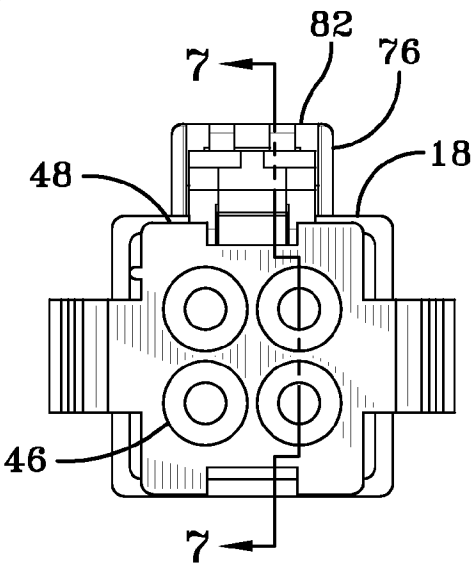
FIG. 3 is a front view of the fully assembled connector assembly of FIG. 2.

In the fully inserted position of FIG. 9, the bottom wall 78 of latch securing member 70 rests on sidewall 18 of male connector housing 10. As best shown in FIG. 2, alignment member 94 is positioned between pivot members 22. Referring again to FIG. 9, inclined member 88 is positioned in close proximity or in engagement with a bottom surface of the disengagement section 26 of the latch member 20. The rear wall 74 is positioned proximate the disengagement section 26. Securing arms 80 extend from the rear wall 74 over and beyond a top surface of the disengagement section 26. The securing shoulders 84 are provided proximate to or in engagement with the disengagement section 26.

In the fully inserted position, the alignment member 94 cooperates with the pivot arms 22 and the sidewalls 76 cooperate with the extension arms 24 to prevent the latch securing member 70 from moving laterally in a direction which is perpendicular to the longitudinal axis of the male connector housing 10. The front face 72 cooperates with the pivot members 22 and the securing shoulders 84 cooperate with the disengagement section 26 to prevent the latch securing member 70 from moving laterally in a direction which is parallel to the longitudinal axis of the male connector housing 10.

In the fully inserted position, the inclined member 88 is positioned in close proximity or in engagement with a bottom surface of the disengagement section 26 of the latch member 20. As the inclined member 88 is not flexible and does not have resilient characteristics, this positioning of the inclined member 88 relative to the disengagement section 26 prevents the disengagement member from being moved toward the sidewall 18, thereby preventing the latch arm 28 from pivoting about pivot members 22 which prevents latch member 20 from disengaging the latch projection 50. This prevents the accidental separation of the connector housing 10 from connector housing, 40. Consequently, the secure connection between the housing even in environments in which the components are tightly spaced.

The latch securing member 70 also performs the function of a connector position assurance member (CPA). If the male connector housing 10 is not fully mated with the female connector housing 40, the latch member 20 will be in a stressed position, with the disengagement section 26 provided closer to the sidewall 18. Complete insertion of the latch securing member will not occur, as the inclined member 88 of the latch securing member 70 will engage the disengagement section 26 close to the front face 72, thereby preventing the further insertion of the latch securing member. Consequently, the inclined surfaces 86 of the securing arms 80 will not move past the disengagement section 26, thereby providing the operator with a visual indication that the mating connectors 10, 40 are not fully mated.

In order to remove the latch securing member 70 from the latch member 20, the securing arms 80 must be resiliently deformed to allow the securing shoulders 84 to move out of the plane of the disengagement section 26. With the shoulders moved, the latch securing member can be slid backward. With the latch securing member 70 removed, the operator can operate the latch member 20 in the normal manner. While the securing arms 80 can be resiliently deformed by the operator, it is extremely difficult for the securing arms 80 to be inadvertently deformed by a cable or the like. The configuration of the inclined surfaces 86 makes it very difficult for a cable to get tangled around the free end of the securing arms 80. In addition, even if a cable were to be tangled around the securing arms, or if the securing arms would be inadvertently contacted, the relative short length of the securing arms 80 makes is extremely unlikely that the securing arms 80 would inadvertently disengage. As the arms are short, the force required to move free ends and the relative distance the free ends must move ensures that the latch securing member 70 will be reliably maintained on the connector housing 10.

The use of the latch securing member 70 also prevents the cables from engaging the latch member 20. Without the latch securing member 70, the cables could engage and wrap around the latch member 20, causing the cable to interfere with the operation of the latch member 20. This could result in breakage of the latch member 20 or the inability to properly latch or unlatch the latch member 20. The positioning of the latch securing member 70, as shown in FIGS. 2 and 9, eliminates this problem and protects the latch member 20 from tangling with the cable.

The latch securing member of the present invention has numerous advantages, several of which are discussed above. Other exemplary advantages are stated herein, but even more advantages will be apparent to those skilled in the art. As the latch securing member is inserted in a direction which is essentially parallel to the longitudinal axis of the connector, the latch securing member can be used in environments in which space between components must be minimized. The latch securing member can also be used on connectors already installed in the field. As the latch securing members cooperates with known latch members, the housing of the connectors do not have to be modified to accommodate the latch securing members. Many latch securing members currently available require the connector housing to have specific openings or shoulders provided therein to accommodate the latch securing members. No such special molding of the connector housings is required for this invention. The invention also required no special tools for insertion or removal. This facilitates the effective usefulness of the present invention in the marketplace.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A connector assembly having a first connector housing, a second connector housing and a latch securing member, the connector assembly comprising:

the first connector housing having a latch member which extends from a first wall of the first connector housing, the latch member has a latch projection engagement section and a disengagement section;

the second connector housing having a latch projection which extends from a second wall of the second connector housing and cooperates with the latch projection engagement section of the first connector when the first and second connector are mated together;

the latch securing member having an inclined member and a securing arm, the inclined member extends from proximate a front face of the latch securing member to a rear wall and is positioned proximate a bottom wall at the front face and is inclined toward a top surface, the inclined member cooperates to maintain the disengagement section of the first connector in position when the latch securing projection is properly mated to the first connector housing and the securing arm cooperates with the disengagement section to prevent the inadvertent removal of the latch securing member from the latch member;

whereby in the fully mated position, the latch projection engagement section of the first connector housing engages the latch projection of the second connector housing to form a locking member and the disengagement section of the first connector housing engages the inclined member of the latch securing member which prevents the disengagement section from being moved to a disengagement position, thereby ensuring that the latch projection engagement section will remain in contact with the latch projection, preventing the disengagement of the first connector housing from the second connector housing.

2. A connector assembly as recited in claim 1 wherein the latch securing member has sidewalls extending between the front face and the rear wall, the bottom wall extends from the rear wall in a direction essentially perpendicular to the rear wall.

3. A connector assembly as recited in claim 2 wherein the securing arm extends from the rear wall toward the front face, the securing arm is positioned proximate the top surface.

4. The connector assembly as recited in claim 3 wherein the securing arm has an inclined surface provided on a portion of the securing arm which is positioned nearest the front face.

5. The connector assembly as recited in claim 4 wherein the securing arm has a securing shoulder provided proximate the inclined surface.

6. The connector assembly as recited in claim 2 wherein an alignment member projects from the front face and is positioned in essentially the same plane as the bottom wall.

7. The connector assembly as recited in claim 6 wherein lead-in surfaces are positioned on either side of the alignment member.

8. The connector assembly as recited in claim 1 wherein the latch member of the first connector housing has two pivot members that are attached to the first wall, two extension arms extend from the pivot members to the disengagement section.

9. The connector assembly as recited in claim 8 wherein a latch arm extends from the disengagement section beyond the pivot members toward a front face of the first connector housing to the latch projection engagement section, the latch projection engagement section has a latching shoulder and an inclined surface.

10. A connector assembly as recited in claim 1 wherein in the fully mated position, the bottom wall of the latch securing member rests on the first wall of the first connector housing, the alignment member is positioned between the pivot members, the inclined member is proximate to a bottom surface of the disengagement section of the latch member, the rear wall of the latch securing member is positioned proximate the disengagement section, the securing arms extend from the rear wall over and beyond a top surface of the disengagement section, with the securing shoulders of the securing arms provided proximate to the disengagement section.

11. A connector assembly as recited in claim 10 wherein the alignment member cooperates with the pivot arms and the sidewalls of the latch securing member cooperate with the extension arms to prevent the latch securing member from moving laterally in a direction which is perpendicular to the longitudinal axis of the first connector housing, the front face cooperates with the pivot members and the securing shoulders cooperate with the disengagement section to prevent the latch securing member from moving laterally in a direction which is parallel to the longitudinal axis of the first connector housing.

12. A connector assembly as recited in claim 11 wherein the inclined member is positioned proximate the bottom surface of the disengagement section of the latch member, whereby as the inclined member is not flexible, the inclined member prevents the disengagement member from being moved toward the first wall which prevents the latch arm from pivoting about the pivot members which prevents the latch member from disengaging the latch projection.

13. A latch securing member for use in maintaining a first connector having at least one latching arm in latching engagement with a second connector having at least one latch projection, the latch securing member comprising:

a front face, a rear wall and sidewalls extending therebetween;

a bottom wall extends from the rear wall in a direction essentially perpendicular to the rear wall;

an inclined member extends from proximate the front face to the rear wall, the inclined member is positioned proximate the bottom wall at the front face and is inclined toward a top surface;

at least one securing arm extends from the rear wall toward the front face, the at least one securing arm is positioned proximate the top surface;

whereby the inclined member is positioned to cooperate with the at least one latching arm of the first connector to prevent the at least one latching arm from disengagement from the at least one latching projection of the second connector, and the at least one securing arm cooperates with the at least one latching arm to maintain the latch securing member in position relative to the at least one latching arm.

14. The latch securing member as recited in claim 13 wherein each at least one securing arm has an inclined surface provided on a portion of the at least one securing arm which is positioned nearest the front face.

15. The latch securing member as recited in claim 14 wherein each at least one securing arm has a securing shoulder provided proximate the inclined surface.

16. The latch securing member as recited in claim 13 wherein an alignment member projects from the front face and is positioned in essentially the same place as the bottom wall.

17. The latch securing member as recited in claim 13 wherein lead-in surfaces are positioned on either side of the alignment member.

18. A latch securing member for use in maintaining a first connector having at least one latching arm in latching engagement with a second connector having at least one latch projection, the latch securing member comprising:

a front face and a rear wall;

a bottom wall extends from the rear wall;

an inclined member extends from proximate the front face to the rear wall, the inclined member is positioned proximate the bottom wall at the front face and is inclined toward a top surface;

at least one securing arm extends from the rear wall toward the front face;

whereby the inclined member is positioned to cooperate with the at least one latching arm of the first connector to prevent the at least one latching arm from disengagement from the at least one latching projection of the second connector, and the at least one securing arm cooperates with the at least one latching arm to maintain the latch securing member in position relative to the at least one latching arm.

* * * * *